United States Patent [19]

Stout

[11] Patent Number: 4,515,217

[45] Date of Patent: May 7, 1985

[54] PERFORATING GUN PRESSURE ACTIVATED SLIDING SLEEVE

[75] Inventor: Gregg W. Stout, Montgomery, Tex.

[73] Assignee: Baker Oil Tools, Inc., Orange, Calif.

[21] Appl. No.: 565,361

[22] Filed: Dec. 27, 1983

[51] Int. Cl.[3] ..... E21B 34/08; E21B 43/116

[52] U.S. Cl. ..... 166/297; 166/55.1; 166/317; 166/319; 166/373

[58] Field of Search ..... 166/297, 299, 55.1, 166/63, 317, 319, 321, 311, 370, 373, 376, 378, 386; 175/4.52, 4.54, 4.59

[56] References Cited

U.S. PATENT DOCUMENTS

| | | | |
|---|---|---|---|
| 2,251,977 | 8/1941 | Burt | 166/319 |
| 4,151,880 | 5/1979 | Vann | 166/314 |
| 4,299,287 | 11/1981 | Vann et al. | 166/297 |
| 4,330,039 | 5/1982 | Vann et al. | 166/297 |
| 4,436,155 | 3/1984 | Brieger | 166/297 |

*Primary Examiner*—James A. Leppink
*Assistant Examiner*—Hoang C. Dang
*Attorney, Agent, or Firm*—Norvell & Associates

[57] ABSTRACT

A method and apparatus for effecting the perforation of a well casing and the adjoining production formation comprises a tubular housing connected between a perforating gun housing and the lower end of a tubular string. The perforating gun housing contains a firing mechanism, and the tubular housing contains a radial port normally closed by a sleeve. The sleeve is inserted at the surface in an open bottom, annular chamber, thus trapping surface ambient air between one end of the sleeve and the closed end of the fluid pressure chamber. The other end of the fluid pressure chamber is connected by fluid passage means to the interior of the perforating gun housing, hence gas pressure generated by the discharge of the perforating gun and formation fluid pressure produced by formation fluids flowing through the newly formed perforations are brought in contact with the other end of the sleeve. The sleeve is shear pinned in its port closing position, but is shiftable to a port opening position by the excess fluid pressure forces exerted by the firing of the perforating gun and the flow of formation fluids into the perforating gun housing. Normally, the fluid pressure in the tubular housing at the time of perforating is substantially less than the anticipated formation fluid pressure.

9 Claims, 4 Drawing Figures

PERFORATING GUN PRESSURE ACTIVATED SLIDING SLEEVE

BACKGROUND OF THE INVENTION

History of the Prior Art

There are many production formations encountered in the drilling of modern oil wells wherein it is desirable to effect the perforating of the casing and the adjoining production formation in an "underbalanced" condition, i.e., where the fluid pressure within the casing immediately adjacent the production formation, and the tubular string connected to such casing region, are maintained at a substantially lower fluid pressure than the anticipated fluid pressure of the production formation. When the perforating gun is fired under these conditions, the production fluid flows rapidly through the resulting perforations into the casing and up the tubular string, carrying with it all debris resulting from the perforating operation, hence cleaning the fractures in the perforated formation for more efficient production flow when the well is completed. It is also sometimes desirable to minimize debris settlement from kill fluids or mud systems on top of go-devil actuated firing heads. A gun pressure activated sliding sleeve allows the operator to maintain clean fluids above the firing head up until the time the well is perforated. Upon perforation, the sleeve opens and allows well fluids to flow up the work string.

In order to efficiently utilize the underbalanced perforating, a packer is generally run into the well on a tubular string and set immediately above the region of the well casing to be perforated. The perforating gun is suspended from the packer by a tubular string which is fluid connected to a tubular work string. Other tools, such as chemical treatment, washing and/or gravel packing tools, may be connected in the same tool string either above or below the packer. In any event, the assembled tool string is run into the well with an essentially dry condition existing in the tool string, thus assuring that the fluid pressure in the tool string is substantially below that anticipated to exist in the formation to be perforated.

To permit the free flow of production fluid from the perforated formation, it is necessary that radial ports be opened in the tubular string below the packer and above the perforating gun. It has previously been proposed, for example, in U.S. Pat. No. 4,151,880 (Vann), that a radially ported, wire line actuated sleeve valve be mounted in this position. The utilization of a wire line actuated valve necessarily introduces delay in effecting the opening of the radial ports in the tubing string, thus delaying the initial flow of production fluid from the perforation formation. U.S. Pat. No. 4,299,287 (Vann) proposes to use a freely falling detonating bar to shift the sleeve valve. This can result in slowing the speed of the detonating bar to a level insufficient to fire the gun.

SUMMARY OF THE INVENTION

This invention provides a method and apparatus for effecting the perforating of a well casing and the adjoining production formation in an underbalanced condition wherein a radially ported sleeve valve disposed between a packer and a perforating gun is automatically opened in response to the fluid pressure generated in the casing annulus surrounding the sleeve valve following the discharge of the perforating gun. This invention also provides a means for controlling mud settlement on top of the firing head.

More specifically, the radially ported sleeve valve embodying this invention comprises a housing having radial ports formed therein and additionally, an axially extending, annular fluid pressure chamber traversing the radial ports. In the run-in position of the tool, the radial ports are closed by a sleeve which is sealably mounted within the annular fluid pressure chamber and thus can also function as a piston. One or more shear pins secures the sleeve in its port closing position. Since the sleeve is inserted at the surface, the inserted end of the sleeve is exposed to air at ambient pressure which is trapped in the closed end of the annular fluid pressure chamber by the sleeve.

Conduit means are provided in the housing communicating with the interior of the housing of the perforating gun. Thus, when the perforating gun is fired, either by dropping a detonating bar on a primer, or by an electric wire line, or by a hydraulic pressure differential, the other end of the sleeve is exposed to the combustion gases resulting from the firing of the gun and, additionally, to the fluid pressure of the incoming formation fluids flowing through the newly formed perforations. Since the fluid pressure within the ported valve housing is normally maintained at a level substantially below the anticipated formation fluid pressure, the formation fluids flow rapidly into the perforating gun housing, and the combined fluid pressure of the explosive gases and the formation fluids are sufficient to effect the shearing of the shear pins holding the sleeve in its port closing position and the shifting of such sleeve to a port opening position, thus permitting the formation fluids to flow freely up the tubular string.

Further advantages of the invention will be readily apparent to those skilled in the art from the following detailed description, taken in conjunction with the annexed sheets of drawings on which is shown a preferred embodiment of the invention.

DESCRIPTION OF THE PREFERRED EMBODIMENT

Figure 1A:
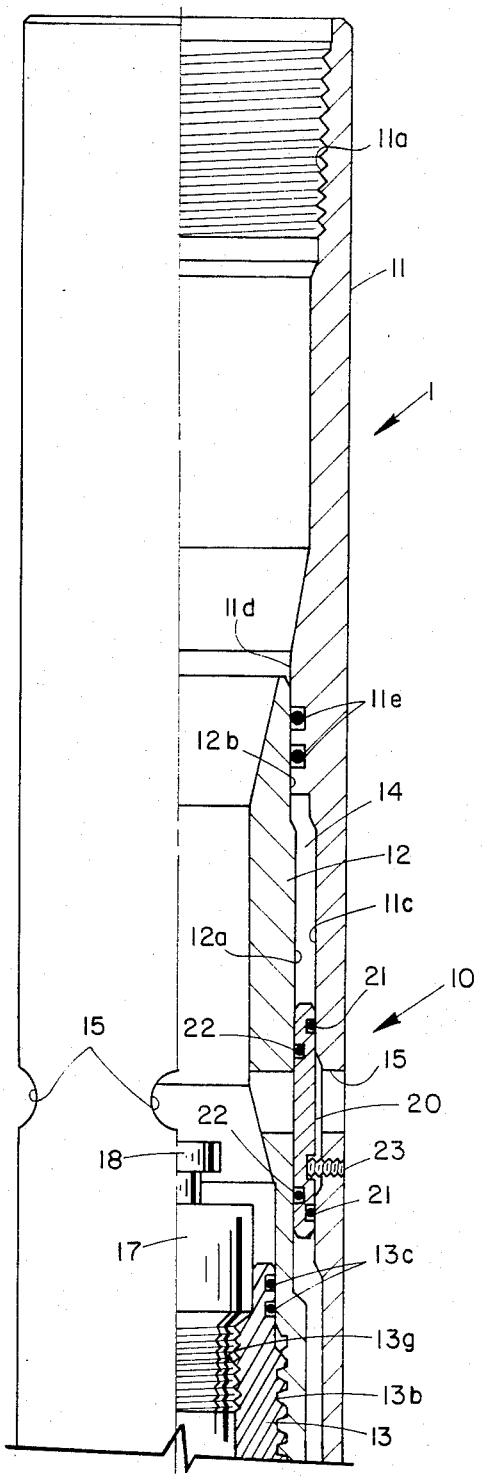
FIGS. 1A and 1B collectively constitute a vertical quarter-sectional view of a valve for connection in a tubular string immediately above a perforating gun to permit the firing of the gun in an underbalanced pressure condition with respect to the production formation, with the components of the valve mechanism being shown in the run-in position.
Figure 1B:
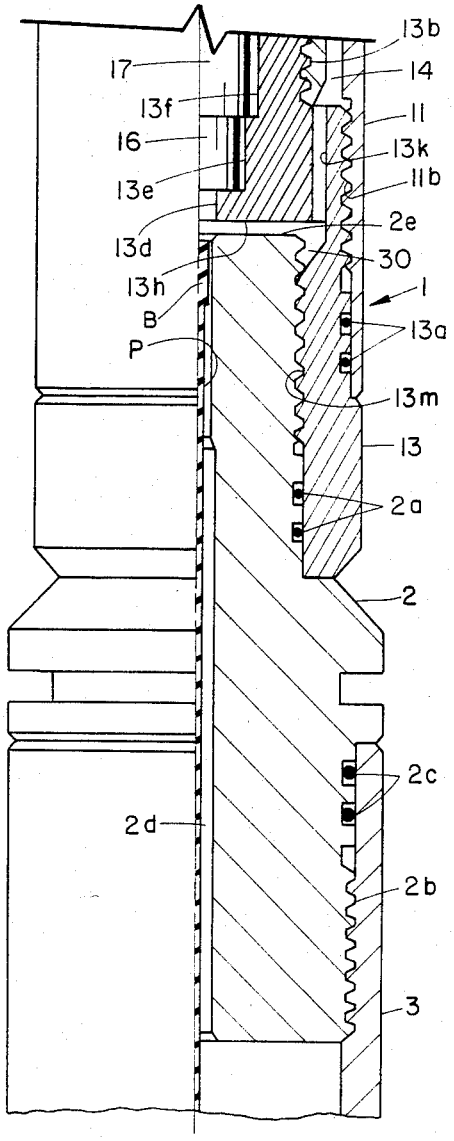

Referring to FIGS. 1A and 1B, the method of this invention is practiced through the insertion of a valving tool with firing mechanism 1 between a tubular string (not shown) and the top end of a perforating gun of which only the firing head adaptor 2 and hollow carrier 3 are shown.

The valving tool comprises a housing 10 fabricated by the threaded assemblage of three elements, namely, an outer housing 11, an inner housing 12 and a connecting sleeve 13. The outer housing 11 is provided with internal threads **11*a* for conventional sealed connection to the end of a tubular tool string, which generally includes a packer and may include additional tools, such as perforation washers and/or gravel packing apparatus. The bottom end of outer housing 11***a* is provided with internal threads 11*b* which cooperate with external threads provided on the upper portion of the connection sleeve 13. This threaded connection is sealed by O-rings 13*a*.

The connecting sleeve 13 is additionally provided with a second set of external threads 13*b* of smaller diameter than those cooperating with the threads 11*b* and these threads 13*b* cooperate with internal threads formed on the bottom end of the inner housing 12. This threaded connection is sealed by O-rings 13*c*. The cylindrical exterior wall 12*a* of the inner housing 12 cooperates with the interior cylindrical wall 11*d* of outer housing 11 to define an annular fluid pressure chamber 14. The upper end of annular fluid pressure chamber 14 is closed by a radially inwardly thickened portion 11*d* formed on outer housing 11 and mounting O-ring seals 11*e* for sealing engagement with the top cylindrical end surface 12*b* of the inner housing 12.

A plurality of radial ports 15 are provided in the valve housing 10 which traverse the annular fluid pressure chamber 14. Ports 15 pass through both the inner housing 12 and the outer housing 11 and thus provide unimpeded fluid passage for any fluids surrounding the valve housing 10 in the casing annulus and having a higher pressure than that existing within the bore of such housing.

In assembling the valving tool 1 at the surface, a sleeve 20 is slidably and sealably inserted within the annular fluid pressure chamber 14, thus trapping a quantity of air at surface ambient pressure above the sleeve 20. Sleeve 20 carries a pair of axially spaced O-rings 21 which sealingly cooperate with the internal cylindrical surface 11*c* of the outer housing 11, and a pair of axially spaced O-rings 22 which sealingly cooperate with the external cylindrical surface 12*a* of the inner housing 12. When the sleeve 20 is assembled in the fluid pressure chamber 14, it is positioned so that the axially spaced seals provided thereon straddle the radial ports 15, thus effectively sealing said ports. The sleeve 20 is releaseably secured in this position by one or more shear pins 23.

The lower end of connecting sleeve 13 is provided with internal threads 13*m* for threadable connection to external threads formed on a firing head adaptor 2 of a perforating gun. O-ring seals 2*a* seal such threaded connection. The bottom end of firing head adaptor 2 is provided with external threads 2*b* for mounting thereon the hollow carrier 3 of the perforating gun. O-rings 2*c* effect the sealing of this threaded joint.

The connecting sleeve 13 is additionally provided with a central bore 13*d* which is counterbored at 13*e* to fixedly mount a detonatable primer 16. An additional counterbore 13*f* provided at its top end with threads 13*g* mounts a conventional hammer and firing pin mechanism 17 having an axially shiftable hammer 18 exposed at its upper end.

The bore 13*d* of the connecting sleeve 13 is in fluid communication with a central bore 2*d* extending through the firing head adaptor 2 and this bore 2*d* mounts booster B and a primer cord P in conventional fashion leading to the shaped charges (not shown) mounted within the perforating gun housing 3.

In the assembly of the components heretofore mentioned, an annular chamber 30 is provided between the upper face 2*e* of the firing head adaptor 2 and a downwardly facing surface 13*h* formed on the connecting sleeve 13. This annular chamber 30 is in fluid communication with the bottom end of the annular fluid pressure chamber 14 through the provision of peripherally spaced, vertical holes 13*k* formed in the connecting sleeve 13.

It will therefore be apparent that when the perforating gun housing 3 is lowered into the well on a tubular string and positioned opposite the region where perforations are desired, the interior of the valve housing 10 and the perforating housing 3 may be maintained at a fluid pressure substantially less than the anticipated fluid pressure of the formation to be perforated. Thus, the tubing string may be run into the well in an essentially dry condition, or a minimum amount of fluid may be contained therein. With this pressure condition, the perforating gun is then fired, usually by dropping a detonating bar (not shown) on the upstanding hammer 16. Of course, an electrically actuated firing of the gun may be achieved by running a wire line in the bore of the tubular string which is preconnected to a suitable electric firing mechanism connected to the firing head adaptor 2.

Figure 2A:
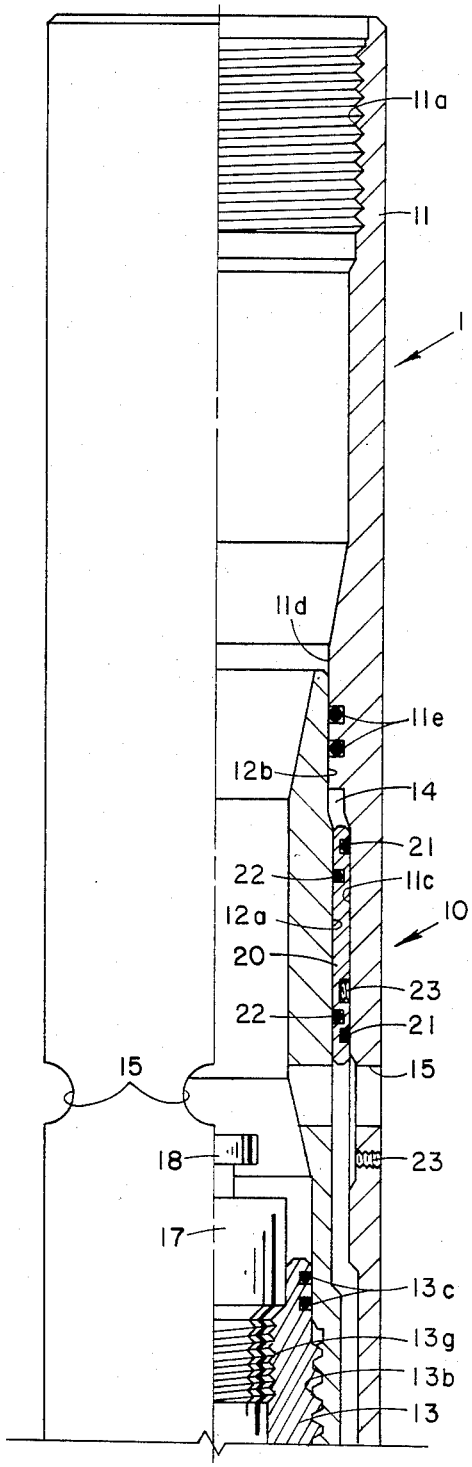
FIGS. 2A and 2B are views respectively similar to FIGS. 1A and 1B, but illustrate the position of the valve components following the firing of the perforating gun.
Figure 2B:
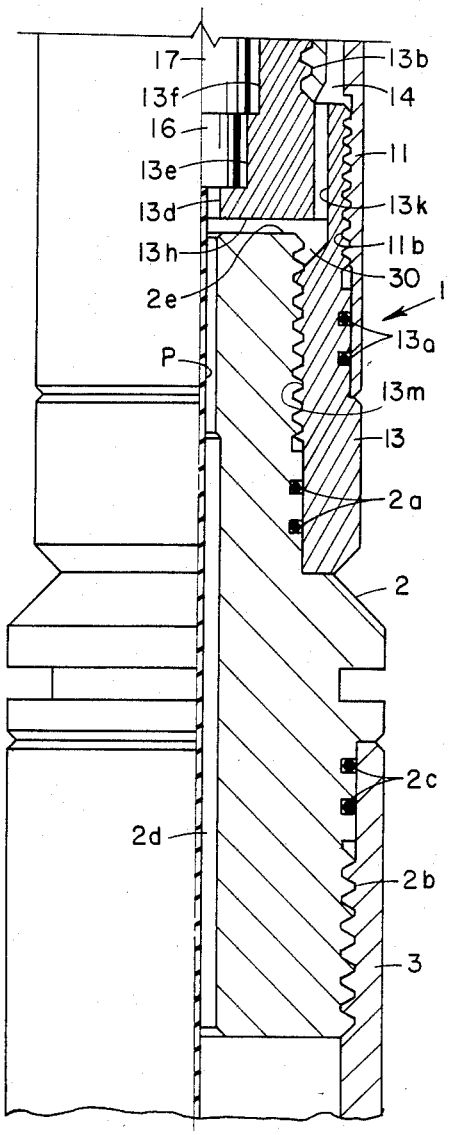

Upon firing of the perforating gun, a charge of gases generated by such firing will travel up the central bore 2*d* of the firing head adaptor 2 and into the lower end of the annular fluid pressure chamber 14. This charge of gas in and of itself may be sufficient to effect the shearing of pins 23 and hence, permit the piston 20 to be driven upwardly to the position illustrated in FIG. 2A wherein the radial ports 15 are fully open. If not moved to this position by the explosive gases, the inrush of formation fluids through the newly formed perforations and into the perforating gun housing 3 and thence upwardly through the bore 2*d* will permit this higher pressure fluid existing around the exterior of the valve housing 10 to be applied to the lower end of the fluid pressure chamber 14 to drive the piston 20 upwardly and effect the opening of the radial ports 15. Once the radial ports 15 are open, the incoming fluid from the formations can freely flow into the interior of the valve housing 10 and thence upwardly through the tubing string to the surface. It is thus assured that all debris resulting from the perforating operation is flushed out of the crevices in the perforated formation, thus contributing to the production efficiency of such formation when the well is placed into production.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed as new and desired to be secured by Letters Patent of the United States is:

1. Apparatus for underbalanced perforating of a well casing and adjoining formation comprising: a tubing string communicable to a perforating gun housing disposed in a well casing, said tubing string including a ported housing above said perforating gun housing; said ported housing above said perforating gun housing; said ported housing having radially spaced walls defining an axially extending, annular fluid pressure chamber and at least one radial port traversing said walls; a sleeve sealably insertable in said annular fluid pressure chamber and axially movable between a closed position crossing at least a portion of said radial port and a non-overlapping open position relative to said radial port; means selectively securing said sleeve in said port closing position, whereby the fluid pressure in said perforating gun housing may be maintained below anticipated formation fluid pressure; and conduit means in said ported housing for applying casing annulus fluid pressure produced by firing the perforating gun to one axial end of said sleeve to shift same to said port opening position.

2. The apparatus of claim 1 wherein a detonatable primer for the perforating gun is fixedly mounted in the lower portion of said ported housing; a booster and a primer cord extending axially from said detonatable primer into said perforating gun housing; said conduit means comprising an annular chamber traversed by said primer cord.

3. The apparatus of claim 1 wherein the other axial end of said sleeve is exposed to air trapped in said annular fluid pressure chamber at the surface.

4. Well perforating apparatus comprising: a hollow perforating gun; a tubular housing having means on its upper end for sealably connecting to a tubing string and means on its lower end for sealably connecting to said perforating gun whereby said perforating gun may be positioned in said casing; said tubular housing having radially spaced walls defining an annular, fluid pressure chamber having two axially spaced ends, one of said ends being closed; port means in said tubular housing traversing said radially spaced walls; a sleeve valve for opening and and closing said port means; said sleeve valve being sealably inserted in said annular fluid pressure chamber at the surface thereby closing said radial port means and trapping ambient pressure in said closed end; means for selectively securing said sleeve valve in said port closing position; conduit means in said housing connecting the other end of said annular fluid pressure chamber to the interior of the perforating gun, thereby exposing one axial end of said sleeve valve to the casing annulus fluid pressure produced by firing the perforating gun.

5. The apparatus of claim 1 wherein a detonatable primer for the perforating gun is fixedly mounted in the lower portion of said tubular housing, a booster and a primer cord extending axially from said detonatable primer into said perforating gun; said conduit means comprising an annular chamber traversed by said primer cord.

6. The method of underbalance perforating a well casing and adjacent formation by a tubing-carriable perforating gun, said tubing having an axially shiftable valve adapted to open and close radial ports in said tubing immediately above said perforating gun; comprising the steps of; at the well surface, selectively securing the axially shiftable valve in its closed position relative to the ports with one portion of said valve entering a fluid pressure chamber to trap surface ambient air pressure therein; positioning the perforating gun at the desired location in the casing; maintaining the fluid pressure in the tubing string adjacent the radial ports at a level below the anticipated formation fluid pressure; and firing the perforating gun and exposing another portion of the axially shiftable valve to a gas fluid pressure generated by the firing of the perforating gun and substantially concurrently to the formation fluid pressure, thereby releasing the axially slidable valve for movement by the casing annulus fluid pressure to an open position relative to said ports.

7. The method of claim 6 wherein step 1 is accomplished by insertion of shearable means disposed through said axially shiftable valve, said shearable means being shearable by the fluid pressure forces exerted on said axially shiftable valve following firing of the perforating gun.

8. The method of claim 6 wherein said axially shiftable valve comprises a piston sleeve sealingly insertable at the well surface in an open bottom, annular fluid pressure chamber, thereby exposing the top end of the piston sleeve to trapped surface ambient air pressure.

9. Apparatus for maintaining substantially clean fluid within a tubing string extending from the top of a subterranean well and communicable to a perforating gun extending within said well, said tubing string including a ported housing above said perforating gun; said ported housing having radially spaced walls defining an axially extending, annular fluid pressure chamber and at least one radial port traversing said walls, said apparatus comprising: a sleeve sealably insertable in said annular fluid pressure chamber and axially movable between a closed position crossing at least a portion of said port and a non-overlapping open position relative to said port; means selectively securing said sleeve in said port closing position, whereby fluid pressure in said tubing string may be maintained below anticipated formation fluid pressure at the perforating gun housing; and conduit means in said ported housing for applying casing annulus fluid pressure produced by firing the perforating gun to one end of said sleeve to shift same to said port opening position.

* * * * *